US006571761B1

(12) United States Patent
Leimer

(10) Patent No.: US 6,571,761 B1
(45) Date of Patent: Jun. 3, 2003

(54) VALVE STEM SEAL ASSEMBLY WITH INTEGRAL BOTTOM SEAL

(75) Inventor: Mark Alan Leimer, Fort Wayne, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/066,425

(22) Filed: Jan. 31, 2002

(51) Int. Cl.[7] ..... F02N 3/00
(52) U.S. Cl. ..... 123/188.6
(58) Field of Search ..... 123/188.6

(56) References Cited

U.S. PATENT DOCUMENTS

| | | | | |
|---|---|---|---|---|
| 3,326,562 A | | 6/1967 | Deuring | |
| 4,325,558 A | * | 4/1982 | Poggio | 123/188.6 |
| 4,834,037 A | | 5/1989 | Lafever | |
| 6,148,783 A | | 11/2000 | Hesher et al. | |
| 6,270,082 B1 | * | 8/2001 | Hegemier | 138/141 |

FOREIGN PATENT DOCUMENTS

| | | | |
|---|---|---|---|
| JP | 10-205623 | * | 8/1998 |

* cited by examiner

*Primary Examiner*—Noah P. Kamen
(74) *Attorney, Agent, or Firm*—Rader, Fishman & Grauer PLLC

(57) ABSTRACT

A valve stem seal assembly includes a retainer with an elastomeric seal body bonded to the interior of the retainer. The seal body includes first and second annular sealing members that engage a valve stem and valve guide, respectively. The seal body also includes a third annular sealing member that protrudes slightly below a bottom surface of a lower flanged portion of the retainer, adapted to engage a cylinder head. Poor machining of the valve guide, and or the cylinder head, often creates a leak path for oil to flow beneath the seal, and through openings between valve guide and cylinder head. The third annular sealing member seals the leak path. The elastomeric seal body also includes axially disposed ribs near the bottom of the retainer with window-like exposed metal spacer areas between ribs, which lowers cost of the seal assembly through reduced amount of elastomeric material required for manufacture.

9 Claims, 1 Drawing Sheet

VALVE STEM SEAL ASSEMBLY WITH INTEGRAL BOTTOM SEAL

BACKGROUND OF THE INVENTION

1. Field of Invention

The present invention relates to valve stem seal assemblies for use in internal combustion engines, and particularly to sealing media applied to metal retainers of such valve stem seal assemblies including bottom flange portions of such assemblies.

2. Description of the Prior Art

Those skilled in the art will appreciate the manner in which intake and exhaust valves are employed in cylinder heads of internal combustion engines. Such valves include integral elongated stems extending away from the engine cylinder heads, the ends of the stems interacting with rotating cams for cyclic repeated opening and closure of the valves during the combustion cycle. The valve stems thus move reciprocally to and from the cylinder head, and so-called valve stem seal assemblies, also variously called oil seal assemblies, are used to seal against leakage of oil through a clearance path between each annular engine valve guide and an associated valve stem supported for reciprocal motion within that particular guide. Obviously, in order to permit unobstructed reciprocal movement of the stem in the guide, some mechanical clearance must exist between the valve guide and the moving stem.

Thus, as is well known, the intake ports of a combustion chamber are opened and closed by the reciprocating motion of at least one intake valve, which in turn is driven by the rotary motion of a cam, the latter being affixed to and rotary with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of the same construction, and include stems integrally affixed to the valves.

In the typical engine, an oil seal assembly is fitted over each valve stem, each assembly being frictionally mounted over an associated valve guide to assure its securement within the engine. Typically each oil assembly has two primary parts; 1) an elastomeric oil seal positioned at one end to control leakage of oil between the valve stem and guide as noted, and 2) a structural cylindrical part called a retainer which is mounted atop of and frictionally secured to the valve guide. In some cases, the retainer has a so-called lower or bottom flange that extends from the top of the valve guide downwardly to the cylinder head deck.

The cylinder head deck provides support for the bottom flange on which the valve return springs bear. Generally, the spring pressure against the bottom flange is sufficient to deter or otherwise avoid usually minor leakages of oil between the valve guide and the engine cylinder head deck. However, there are some environments that foster significant oil leakage between the normally press-fit interface between the bottom flange and cylinder head deck, e.g. in cases of poor machining or large tolerances.

The present invention deals with the latter situations.

SUMMARY OF THE INVENTION

An improved system for sealing between the bottom flange of a valve stem seal assembly and a cylinder head deck of an internal combustion engine is provided. The valve stem seal assembly includes a supporting metallic outer retainer having a lower or bottom-flanged portion, and an interiorly disposed elastomeric seal body bonded to the retainer. The elastomeric seal body includes first and second annular sealing members that engage a valve stem and valve guide, respectively. The elastomeric seal body also includes a third annular sealing member that extends slightly below the bottom surface of the valve guide, as defined by the bottom flanged portion of the retainer, and rests against the cylinder head. Poor machining of the valve guide, and or the cylinder head deck, often creates a leak path for undesirable admission of oil beneath the seal, and through openings between the guide and the cylinder head. The third annular sealing member seals the latter leak path.

The elastomeric seal body also includes axial ribs near the bottom of the retainer, which extend axially toward the cylinder head. The ribs are formed during the manufacture of the valve stem, and represent material left and cured in sprues during manufacture of the part, as will be further explained herein. The ribs are part of the elastomeric seal body, and define outlines of metallic windows disposed between the ribs. Absence of elastomeric material in the window areas represents lower cost of manufacture due to reduced amount of elastomeric material required for manufacture.

Finally, the bottom flange of the metallic retainer supports return springs of a reciprocating valve and stem. The springs assure continuous pressure on the bottom flange, which coupled with the bottom or third elastomeric sealing member, acts to prevent leakage of oil between the flange and the cylinder head deck.

DETAILED DESCRIPTION OF THE PREFERRED EMBODIMENTS

Figure 1:
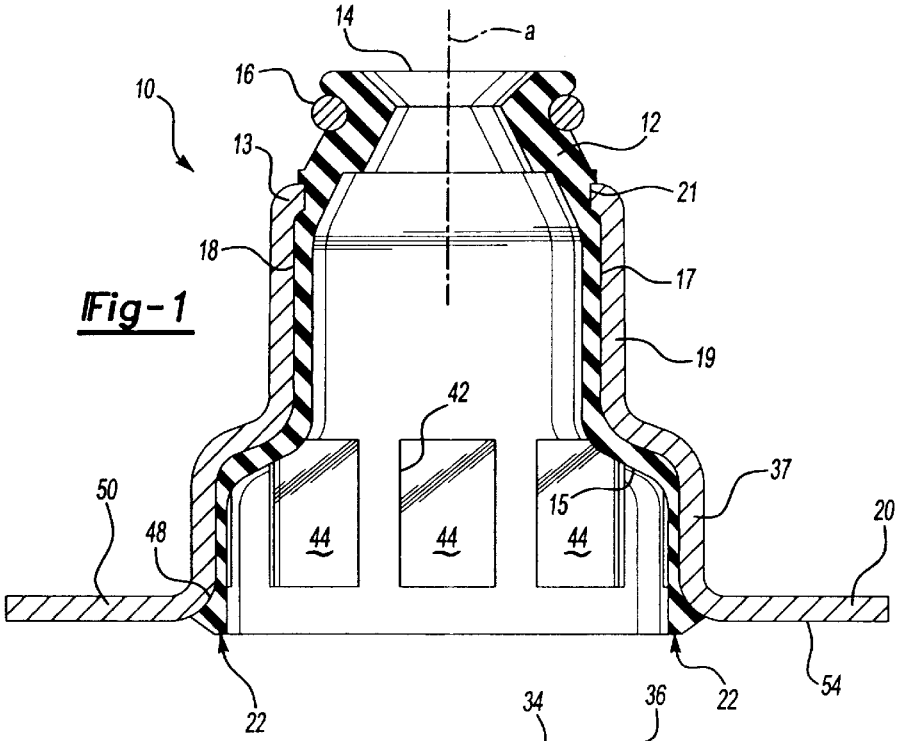
FIG. 1 is a cross-sectional view of one embodiment of the valve stem seal assembly of the present invention, revealing an elastomeric seal body and metallic retainer to which the seal body is bonded in one preferred embodiment.

Referring initially to FIG. 1, a valve stem seal assembly 10 incorporates an elastomeric seal body 12 fixed to an end wall 13 of a cylindrical retainer 19. The seal body 12 is defined by a generally cylindrical structure having an axis a—a, and includes interior and exterior surfaces 15 and 17, respectively. The seal body 12 is supported in the end wall 13 by means of an exterior groove 21 formed in the exterior surface 17 of the seal body, as revealed in FIG. 1. The interior surface 15 of the seal body 12 contains a circumferentially extending valve stem sealing lip 14 adapted to engage a stem of a reciprocally movable valve stem assembly, as will be further described. In the preferred form described herein, the seal body 12 also incorporates a valve guide sealing portion 18 adapted to engage a valve guide, as will also be further described.

Figure 2:
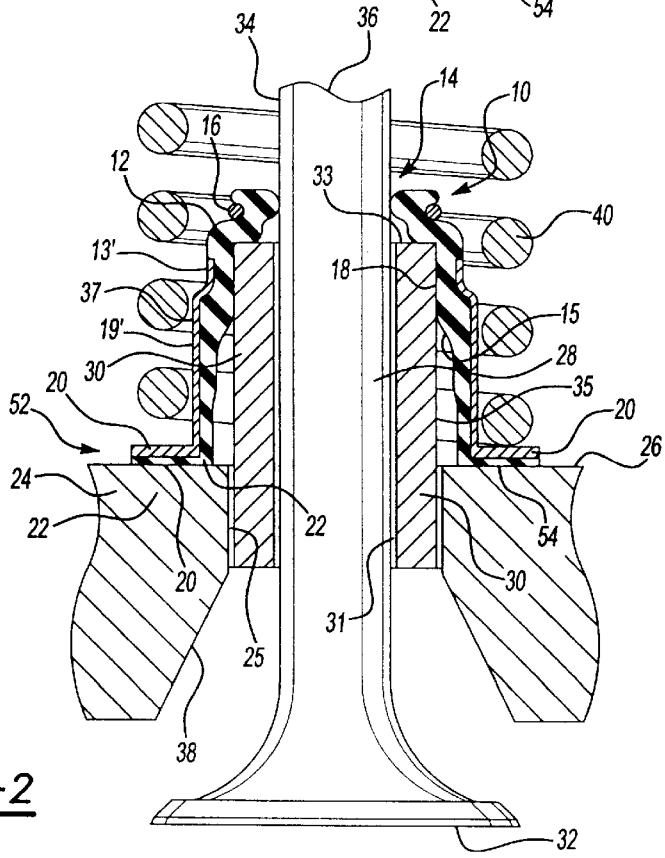
FIG. 2 is cross-sectional view of a second embodiment of a valve stem seal assembly, wherein the seal assembly is shown installed atop of a valve guide extending upwardly from a cylinder head deck, the seal assembly engaging a valve stem in accordance with contemplated usage of the present invention.

Referring now also to FIG. 2, a second embodiment of the described valve stem seal assembly 10 is shown installed over or atop a valve guide 30 in the environment of an engine (not shown). As depicted, the seal assembly is frictionally secured to the annular valve guide 30, which in turn is press fit into, or otherwise frictionally secured within, an aperture 25 that extends through the fragmentarily shown cylinder head 24. It will be apparent that the valve stem assembly 10 is actually installed over that portion of the valve guide that protrudes above the upper deck 26 of the cylinder head 24. A valve stem 34 of a valve assembly 28 is designed to reciprocate within an aperture 31 that extends through the interior of the valve guide 30. It will be noted that in this embodiment the retainer 19' and its endwall 13' are formed differently than in the first described embodiment.

The operation of the valve stem seal assembly 10 and associated valve assembly 28 may now be described as follows. During operation of an engine (not shown), the combustion process occurs in a rapid cyclic fashion. A valve 32 attached to stem 34 is designed to open and close an intake (or exhaust) valve port 38 at a rate of several times per second. A cam on a camshaft (neither shown) urges a cam actuated end 36 of the valve stem 34 downwardly in a reciprocal cyclic manner against the constant force of a valve return spring 40. In accordance with FIG. 2, it will be appreciated that the return spring 40 bears against the upper surface 50 of a bottom flange 20 of the retainer 19.

To the extent that the combustion process occurs within the cylinder head 24, e.g. under the cylinder head deck 26, the valve 32 is positioned adjacent the combustion process. Above the cylinder head deck 26 there exists an oily environment, or one subject to "splash and spray oil" as described in the art. As a result, a valve stem seal assembly 10 is needed to assure that oil does not migrate into the area under the valve 32, i.e. the combustion chamber (not shown).

There are three migration paths along which oil may travel into the combustion chamber. The first extends between the valve stem 34 and the elastomeric sealing lip 14. As previously noted, the annular valve stem sealing lip 14 is the primary gate for deterring oil travel along the first path. A garter spring 16 is disposed in an exterior groove of the seal body 12, circumferentially tensioning the sealing lip 14 against the stem 34 to compensate for wear of the lip over the useful life of the seal assembly.

The second migration path extends between the valve guide and the interior surface 15 of the elastomeric seal body 12. In the presently described embodiment, a portion of the interior surface 15 of the elastomeric seal body comprises a valve guide sealing portion 18, that physically engages the guide 30 to prevent oil flow migration past the top surface 33 of the valve guide 30, and down along a path between the exterior surface 35 of the valve guide 30 and the interior surface 15 of the elastomeric seal 12.

The third migration path is by way of a gap 52, defined by the interface of the cylinder head deck 26 and the underside 54 of the bottom flange 20. The gap 52 leads to the interface between the valve guide 30 and the aperture 25 extending through the cylinder head 24. Thus the present invention contemplates that an elastomeric sealing media 22 is bonded at least to the interior annulus 48 of the bottom surface 54 of the flange 20 for preventing migration of oil along the described third migration path. In accordance with the described method of manufacturing the assembly 10, the bottom flange sealing media 22 will be contiguous with the valve guide-sealing portion 18, as well as the valve stem sealing lip 14.

The bottom flange sealing media 22 may be represented in several distinct embodiments. Although the embodiment described in FIGS. 1 and 2 displays only one configuration of the sealing media 22; i.e. attached to the inside annulus area only of the bottom flange 20, there are other possibilities, including the application of a solid layer of elastomeric material along the entire bottom surface of the flange 20, rather than only at the interior, or radially innermost, edge of the annular bottom flange 20. However, use of greater amounts of elastomeric material would be excessive in a majority of applications.

Incidentally, the description of the seal body 12 has been simply an elastomeric material. It will be appreciated by those skill in the art that depending on the internal pressures and oil migration flow patterns in a given engine, the consistency of the elastomer can be modified with respect to its softness or hardness for achieving an optimal seal. In any event, it will be apparent to those skilled in the art that numerous other sealing media configurations may be viable or suitable for the desired purposes described.

Various methods can be employed for applying the elastomeric sealing media 22 to the underside 54 of flange 20. For example, those skilled in the art will appreciate that the sealing media 22 can be screened printed or pad printed onto an underside or bottom 54 of the retainer flange 20.

Finally, it will be appreciated by those skilled in the art that a bottom interior portion 37 of the retainer 19 is spaced away from the exterior surface 35 of the valve guide 30. As such, there is little need for substantial application of elastomeric material within this region, to the extent that sealing of this particular zone or region is not required. There is, therefore, provided an opportunity to save elastomeric material in the manufacture of the assembly 10.

One such method of saving elastomeric material provides that the circumferential sealing media 22 is molded in-situ to the substrate material of the underside 54 of the bottom flange 20. This approach can be carried out by physically pouring molten elastomer into a mold provided in the interior portion of the seal assembly 10; i.e. within the retainer 19. In such a case, ribs 42 of elastomer are formed on the interior of the retainer (FIG. 1) in areas where sprues and internal runners permit pressurized flow of elastomer to reach areas of the retainer 19 at the bottom flange 20 in a manner adapted to apply the media 22 without wasting elastomer. The various circumferentially spaced windows 44 of exposed metal represent a savings of elastomer in areas where application of elastomeric material is not required. Thus, a cost savings is achieved by means of such a manufacturing procedure.

Although the described embodiments of this invention contemplate that the retainer is formed of metal, other materials may be suitable depending upon the harshness of the particular environment. For example, some glass-filled nylons or other plastics may be suitable for some engine environments, wherein in such cases the retainer might suitably be formed of plastic materials.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A valve stem seal assembly for an internal combustion engine, said assembly comprising:

a) a cylindrical retainer defining a longitudinal axis, said retainer having a cylindrical body defining an interior surface, and a circumferentially oriented annular end wall integral therewith that defines an upper extremity thereof, said end wall positioned radially inwardly relative to said axis, said retainer further defining a lower flanged portion; and b) an elastomeric valve stem seal body disposed on the interior of said cylindrical body of said retainer, said seal body having first and second interiorly disposed annular sealing members, wherein the first annular sealing member is adapted to engage a reciprocally movable valve stem supportably mounted in a valve guide of an internal combustion engine; a portion of the second annular sealing member protrudes below a bottom surface of said lower flanged portion of the retainer, wherein said portion of said second sealing member is adapted to engage a cylinder head portion of the internal combustion engine, said bottom flanged portion of said retainer adapted to be situated against said cylinder head portion, and wherein said second elastomeric sealing member is contiguous with said first elastomeric sealing member, wherein said second elastomeric sealing member including a plurality of circumferentially spaced windows that define areas in which the interior surface of the retainer is exposed.

2. The valve stem seal assembly of claim 1, further comprising a circumferential exterior groove in said seal body disposed for circumferentially receiving said annular end wall, said seal body being fixed relative to said cylindrical retainer; said lower flanged portion of said cylindrical retainer comprising a radially outwardly extending circumferential member defining the bottom extremity of said retainer, and wherein at least the radially innermost interior portion of said bottom extremity comprises said second annular sealing member.

3. The valve stem seal assembly of claim 1, wherein said second elastomeric sealing member is affixed to said bottom extremity of said retainer by being bonded thereto.

4. The valve stem seal assembly of claim 1, wherein said retainer is comprised of metal.

5. A valve stem seal assembly for an internal combustion engine, said assembly comprising:

a) a cylindrical retainer defining a longitudinal axis, said retainer having a cylindrical body defining an interior surface, and a circumferentially oriented annular end wall integral therewith that defines an upper extremity thereof, said end wall positioned radially inwardly relative to said axis, said retainer further defining a lower flanged portion defining an annular surface; and b) an elastomeric valve stem seal body disposed on the interior of said cylindrical body of said retainer, said seal body having first, second and third interiorly disposed annular sealing members, wherein the first annular sealing member is defined by a sealing lip adapted to engage a reciprocally movable valve stem supportably mounted in a valve guide of an internal combustion engine; the second annular sealing member is disposed circumferentially about the interior of said retainer and is contiguous with said first sealing member, wherein the third sealing member protrudes below a bottom surface of said lower flanged portion of the retainer, said bottom flanged portion of said retainer adapted to be situated against said cylinder head portion of the internal combustion engine, wherein said third sealing member is adapted to engage a cylinder head portion of the internal combustion engine, and wherein said third elastomeric sealing member is contiguous with said first and second elastomeric sealing members, wherein said third elastomeric sealing member comprises a plurality of circumferentially spaced windows defined by exposed metallic areas that are void of any elastomeric material.

6. The valve stem seal assembly of claim 5, wherein said windows are circumferentially spaced apart by ribs, said ribs extending parallel to said longitudinal axis, said ribs being formed of runner via a molding process.

7. The valve stem seal assembly of claim 6, wherein said third elastomeric sealing member comprises a unitary circumferential sealing lip bonded to the radially innermost edge of the annular surface of said bottom flanged portion of said assembly.

8. The valve stem seal assembly of claim 7, wherein said elastomeric annular sealing lip is bonded in-situ to a radially innermost edge of said bottom flanged portion.

9. The valve stem seal assembly of claim 5, wherein said retainer comprises a plastic material.

* * * * *